US011320755B2

(12) United States Patent
Nakahara

(10) Patent No.: US 11,320,755 B2
(45) Date of Patent: May 3, 2022

(54) BRILLIANT DEVELOPER, DEVELOPER CONTAINER, DEVELOPING DEVICE, IMAGE FORMING APPARATUS, AND METHOD OF PRODUCING DEVELOPER

(71) Applicant: Oki Data Corporation, Tokyo (JP)

(72) Inventor: Karin Nakahara, Tokyo (JP)

(73) Assignee: Oki Electric Industry Co., Ltd., Tokyo (JP)

( * ) Notice: Subject to any disclaimer, the term of this patent is extended or adjusted under 35 U.S.C. 154(b) by 0 days.

(21) Appl. No.: 17/123,320

(22) Filed: Dec. 16, 2020

(65) Prior Publication Data

US 2021/0200110 A1 Jul. 1, 2021

(30) Foreign Application Priority Data

Dec. 25, 2019 (JP) ..... JP2019-235117

(51) Int. Cl.

| | |
|---|---|
| ***G03G 9/09*** | (2006.01) |
| ***G03G 9/08*** | (2006.01) |
| ***G03G 15/08*** | (2006.01) |

(52) U.S. Cl.

CPC ..... *G03G 9/0926* (2013.01); *G03G 9/0819* (2013.01); *G03G 9/0827* (2013.01); *G03G 15/0822* (2013.01)

(58) Field of Classification Search

CPC .. G03G 9/0902; G03G 9/0825; G03G 9/0827; G03G 9/0926

See application file for complete search history.

(56) References Cited

U.S. PATENT DOCUMENTS

| | | | | |
|---|---|---|---|---|
| 2014/0045113 | A1 | 2/2014 | Takahashi et al. | |
| 2014/0193751 | A1 | 7/2014 | Sugitate et al. | |
| 2018/0059563 | A1* | 3/2018 | Nakamura ..... | G03G 9/0819 |
| 2018/0348657 | A1 | 12/2018 | Kuwabara | |

FOREIGN PATENT DOCUMENTS

| | | | |
|---|---|---|---|
| EP | 3276421 | A1 | 1/2018 |
| JP | 2018084677 | A | 5/2018 |

* cited by examiner

*Primary Examiner* — Peter L Vajda

(74) *Attorney, Agent, or Firm* — Rabin & Berdo, P.C.

(57) ABSTRACT

A brilliant developer contains a metallic pigment containing pigment particles, a binder resin, and an external additive. A percentage of the pigment particles not less than 2 μm and not more than 4 μm in a volume particle size distribution of a residue separated from a mixture obtained by dissolving the brilliant developer in tetrahydrofuran after removing the external additive from the brilliant developer is not less than 21.5% and not more than 25.3%.

9 Claims, 10 Drawing Sheets

FIG. 5

| | | DEVELOPER PARTICLE SIZE (μm) | PIGMENT PARTICLE SIZE (μm) | PERCENTAGE OF PIGMENT PARTICLES FROM 2 TO 4 μm (%) | PERCENTAGE OF PIGMENT PARTICLES GREATER THAN 4 μm (%) | RATIO OF PERCENT-AGES | SURFACE SMOOTH-NESS | SPECULAR REFLEC-TION AREA RATIO (%) | FI VALUE |
|---|---|---|---|---|---|---|---|---|---|
| EXAMPLE 1 | DEVELOPER Da | 16.15 | 5.37 | 26.62 | 73.38 | 1 : 2.8 | EXCEL-LENT | 28.2 | 15.4 |
| EXAMPLE 2 | DEVELOPER Db | 12.84 | 5.80 | 22.85 | 77.69 | 1 : 3.4 | GOOD | 20.1 | 15.5 |
| COMPARATIVE EXAMPLE 1 | DEVELOPER Dc | 16.79 | 8.69 | 9.257 | 90.74 | 1 : 9.8 | POOR | 18.2 | 18.2 |
| COMPARATIVE EXAMPLE 2 | DEVELOPER Dd | 8.619 | 7.101 | 15.45 | 85.1 | 1 : 5.47 | POOR | 18.4 | 16.5 |

*FIG. 7*

| | | PIGMENT PARTICLE SIZE (μm) | Si CONTENT IN DEVELOPER BEFORE EXTERNAL ADDITION | Si CONTENT IN FIRST REMOVAL PROCESS | Si CONTENT IN SECOND REMOVAL PROCESS | DIFFERENCE ( AMOUNT OF EXTERNAL ADDITIVE REMAINING ON SURFACE ) |
|---|---|---|---|---|---|---|
| EXAMPLE 1 | DEVELOPER Da | 5.37 | 1.554 | 1.67 | 1.656 | 0.102 |
| EXAMPLE 2 | DEVELOPER Db | 5.80 | 1.265 | 1.598 | 1.474 | 0.209 |
| COMPARATIVE EXAMPLE 1 | DEVELOPER Dc | 8.69 | 0.577 | 0.724 | 0.737 | 0.16 |

FIG. 8

| | | PARTICLE SIZE OF FRESH PIGMENT (μm) | PERCENTAGE OF PIGMENT PARTICLES FROM 2 TO 4 μm IN FRESH PIGMENT (%) | PARTICLE SIZE OF EXTRACTED PIGMENT (μm) | PERCENTAGE OF PIGMENT PARTICLES FROM 2 TO 4 μm IN EXTRACTED PIGMENT (%) | PERCENTAGE OF PIGMENT PARTICLES GREATER THAN 4 μm IN EXTRACTED PIGMENT (%) | RATIO OF PERCENT-AGES | SURFACE SMOOTH-NESS | SPECULAR REFLEC-TION AREA RATIO (%) | FI VALUE |
|---|---|---|---|---|---|---|---|---|---|---|
| EXAMPLE 1 | DEVEL-OPER Da | 5.37 | 26.62 | 5.44 | 25.3 | 74.7 | 1 : 2.9 | EXCEL-LENT | 28.2 | 15.4 |
| EXAMPLE 2 | DEVEL-OPER Db | 5.8 | 22.85 | 6.15 | 21.5 | 80.69 | 1 : 4.2 | GOOD | 20.1 | 15.5 |
| COMPARATIVE EXAMPLE 1 | DEVEL-OPER Dc | 8.69 | 9.257 | 8.93 | 7.817 | 92.18 | 1 : 11.8 | POOR | 18.2 | 18.2 |
| COMPARATIVE EXAMPLE 2 | DEVEL-OPER Dd | 7.101 | 15.45 | 7.33 | 15.762 | 84.86 | 1 : 5.34 | POOR | 18.4 | 16.5 |

BRILLIANT DEVELOPER, DEVELOPER CONTAINER, DEVELOPING DEVICE, IMAGE FORMING APPARATUS, AND METHOD OF PRODUCING DEVELOPER

BACKGROUND OF THE INVENTION

1. Field of the Invention

Embodiments of the present invention relate to a brilliant developer, a developer container, a developing device, an image forming apparatus, and a method of producing a developer, and are preferably applied to, for example, an electrophotographic printer.

2. Description of the Related Art

Conventionally, there are widely used image forming apparatuses (or printers) that perform printing processes by forming developer images (or toner images) with developer (or toner) by means of image forming units on the basis of images supplied from computers or the like, transferring the developer images onto media, such as paper, and fixing them by applying heat and pressure.

There have been provided image forming apparatuses that use brilliant developers that are developers containing brilliant pigments consisting of metallic pigments, to form images having metallic luster of golden color, silver color, or the like, or brilliant images (see, e.g., Japanese Patent Application Publication No. 2018-84677). Such metallic pigments have sufficiently larger particle sizes than normal color pigments.

However, in image forming apparatuses using conventional developers, when developers containing metallic pigments are used, the print quality may be low.

SUMMARY OF THE INVENTION

An aspect of the present invention is intended to provide a brilliant developer containing a metallic pigment and capable of providing high print quality, a developer container containing the brilliant developer, a developing device using the brilliant developer, an image forming apparatus using the brilliant developer, and a method of producing the brilliant developer.

According to an aspect of the present invention, there is provided a brilliant developer containing: a metallic pigment containing pigment particles; a binder resin; and an external additive, wherein a percentage of the pigment particles not less than 2 μm and not more than 4 μm in a volume particle size distribution of a residue separated from a mixture obtained by dissolving the brilliant developer in tetrahydrofuran after removing the external additive from the brilliant developer is not less than 21.5% and not more than 25.3%.

According to another aspect of the present invention, there is provided a developer container containing the brilliant developer.

According to another aspect of the present invention, there is provided a developing device including: a photoreceptor on which a latent image is formed by illumination; and a developer carrier that develops the latent image by supplying the brilliant developer.

According to another aspect of the present invention, there is provided an image forming apparatus including: the developing device; and a fixing unit that fixes a developer image formed by the developing device to a medium.

According to another aspect of the present invention, there is provided a method of producing a developer by using a dissolution suspension method, the method including: dispersing at least a metallic pigment and a binder resin in an organic solvent to prepare a resin solution, wherein the metallic pigment contains pigment particles, and wherein a percentage of the pigment particles not less than 2 μm and not more than 4 μm in a volume particle size distribution of the metallic pigment is not less than 22.85% and not more than 26.62%.

With these aspects, it is possible to provide a brilliant developer containing a metallic pigment and capable of providing high print quality, a developer container containing the brilliant developer, a developing device using the brilliant developer, an image forming apparatus using the brilliant developer, and a method of producing the brilliant developer.

BRIEF DESCRIPTION OF THE DRAWINGS

In the attached drawings:

FIG. 5 is a table showing results of measurements and evaluations of developers;

FIG. 7 is a table showing results of measurements of silicon content in developers after external additive removal;

FIG. 8 is a table showing results of measurements of metallic pigments extracted from the developers;

DETAILED DESCRIPTION OF THE INVENTION

Embodiments of the present invention will now be described with reference to the drawings.

<1. Configuration of Image Forming Apparatus>

Figure 1:
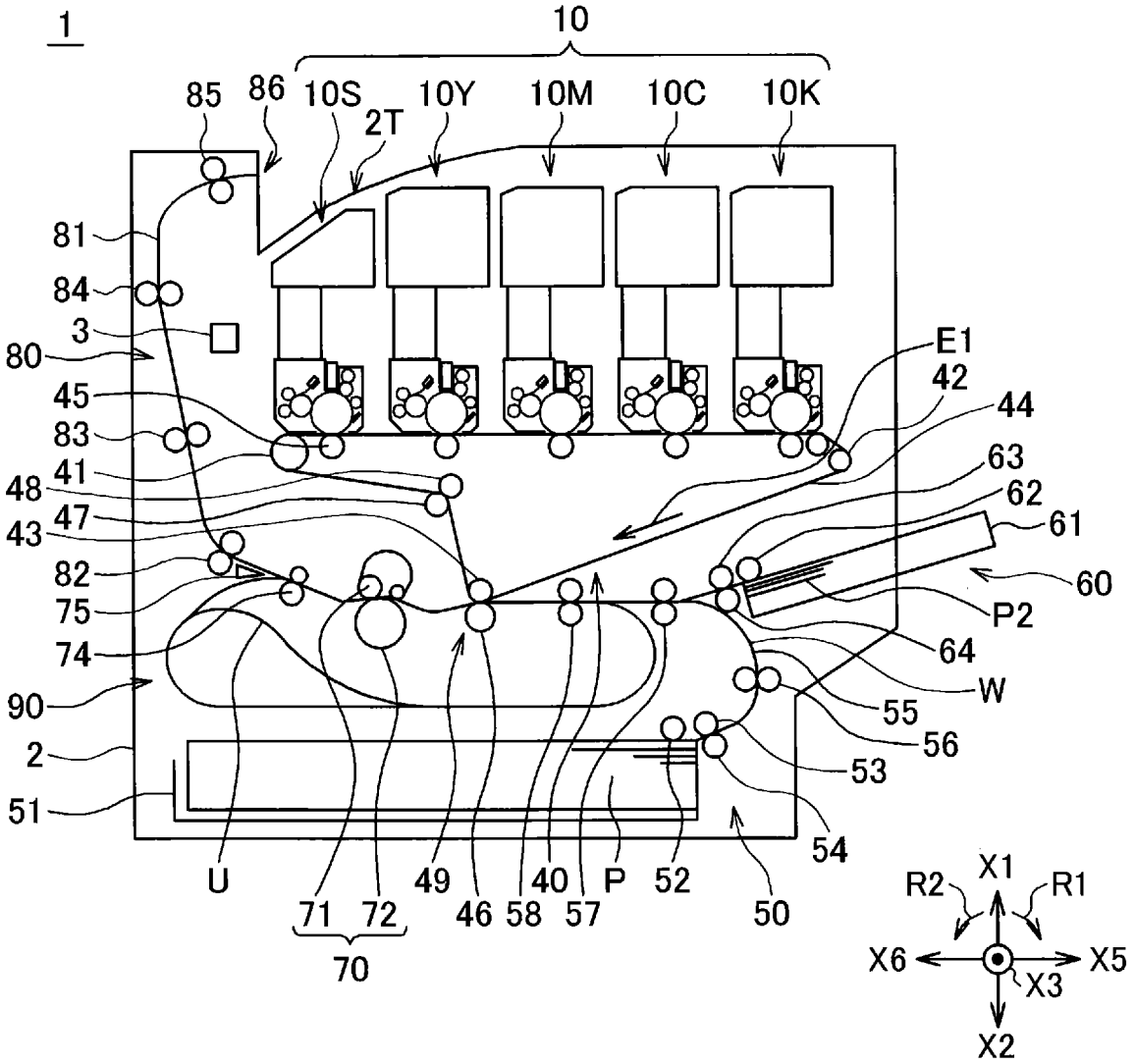
FIG. 1 is a left side view illustrating a configuration of an image forming apparatus.

FIG. 1 illustrates an image forming apparatus 1 according to an embodiment. The image forming apparatus 1 is an electrophotographic color printer, and forms (or prints) a color image on a sheet (e.g., paper sheet) P as a medium. The image forming apparatus 1 is a single function printer (SFP) having a printer function but having neither an image scanner function of reading a document nor a communication function using telephone lines.

The image forming apparatus 1 includes a substantially box-shaped housing 2, in which various components are disposed. The following description assumes that the right end of the image forming apparatus 1 in FIG. 1 is a front side of the image forming apparatus 1, and an up-down direction, a left-right direction, and a front-rear direction are those as viewed toward the front side. In the drawings, the upward, downward, leftward, rightward, forward, and rearward directions are indicated by arrows X1, X2, X3, X4, X5, and X6, respectively.

The image forming apparatus 1 includes a controller 3 that entirely controls the image forming apparatus 1. The controller 3 includes a central processing unit (CPU), a read only memory (ROM), a random access memory (RAM), and the like, which are not illustrated, and performs various processes by reading and executing predetermined programs. Also, the controller 3 is connected wirelessly or by wire to a host apparatus (not illustrated), such as a computer apparatus. Upon receiving, from the host apparatus, image data representing an image to be printed and a command to print the image data, the controller 3 performs a printing process to form a printed image on a surface of a sheet P.

Five image forming units 10K, 10C, 10M, 10Y, and 10S are arranged in this order from the front side toward the rear side, on the upper side of the housing 2. The image forming units 10K, 10C, 10M, 10Y, and 10S correspond to colors of black (K), cyan (C), magenta (M), yellow (Y), and a special color (S), respectively. Although the image forming units 10K, 10C, 10M, 10Y, and 10S correspond to the different colors, they have the same configuration.

The colors of black (K), cyan (C), magenta (M), and yellow (Y), which will be referred to below as normal colors, are colors used in normal color printers. On the other hand, the special color (S) is silver. For convenience of description, the image forming units 10K, 10C, 10M, 10Y, and 10S may be referred to below as image forming units 10.

Figure 2:
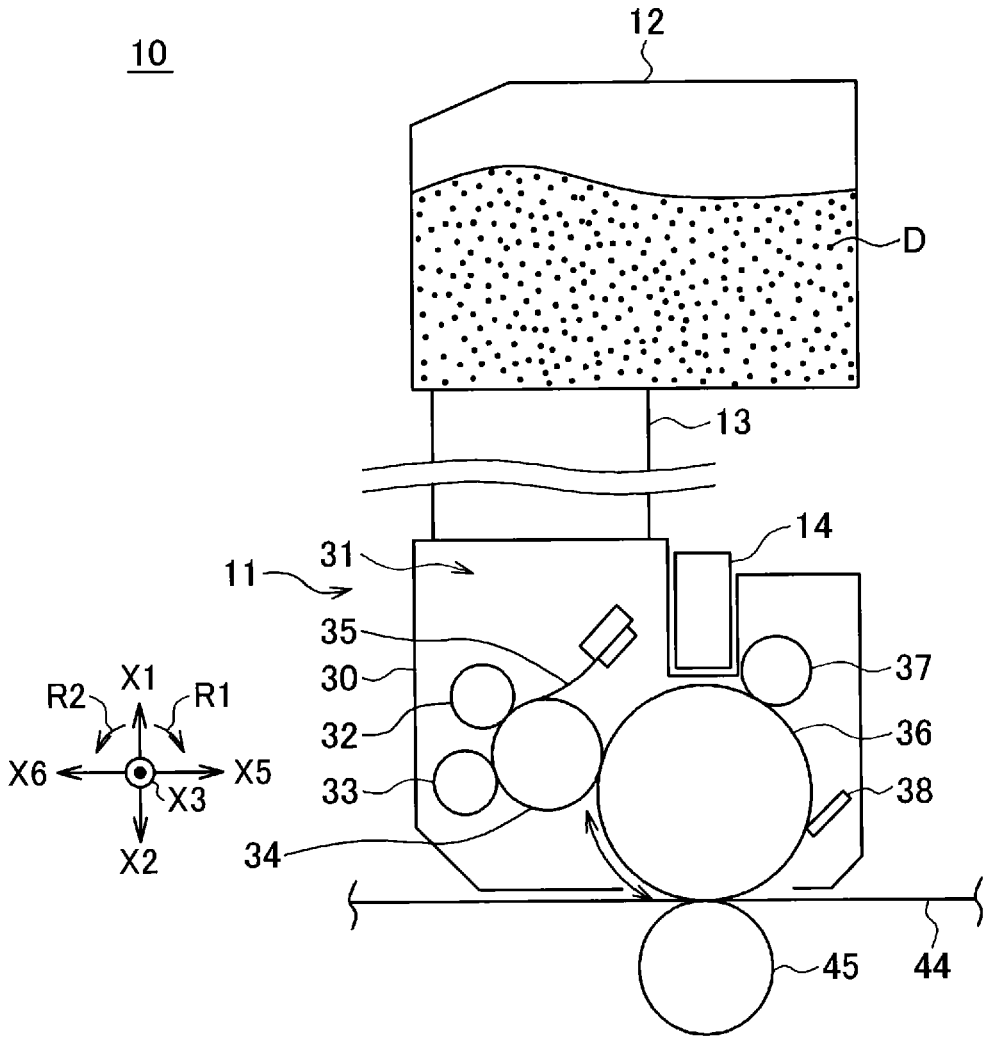
FIG. 2 is a left side view illustrating a configuration of an image forming unit.

As illustrated in FIG. 2, each of the image forming units 10 is roughly constituted by an image forming main portion 11, a developer container 12, a developer supply portion 13, and a light emitting diode (LED) head 14. The image forming unit 10 and its parts have sufficient lengths in the left-right direction corresponding to the length of the sheet P in the left-right direction. Thus, many of the parts are longer in the left-right direction than in the front-rear direction and up-down direction, and formed in shapes elongated in the left-right direction.

The developer container 12 contains developer, and is configured to be attachable to and detachable from the image forming unit 10. When the developer container 12 is attached to the image forming unit 10, it is attached to the image forming main portion 11 via the developer supply portion 13.

Figure 3:
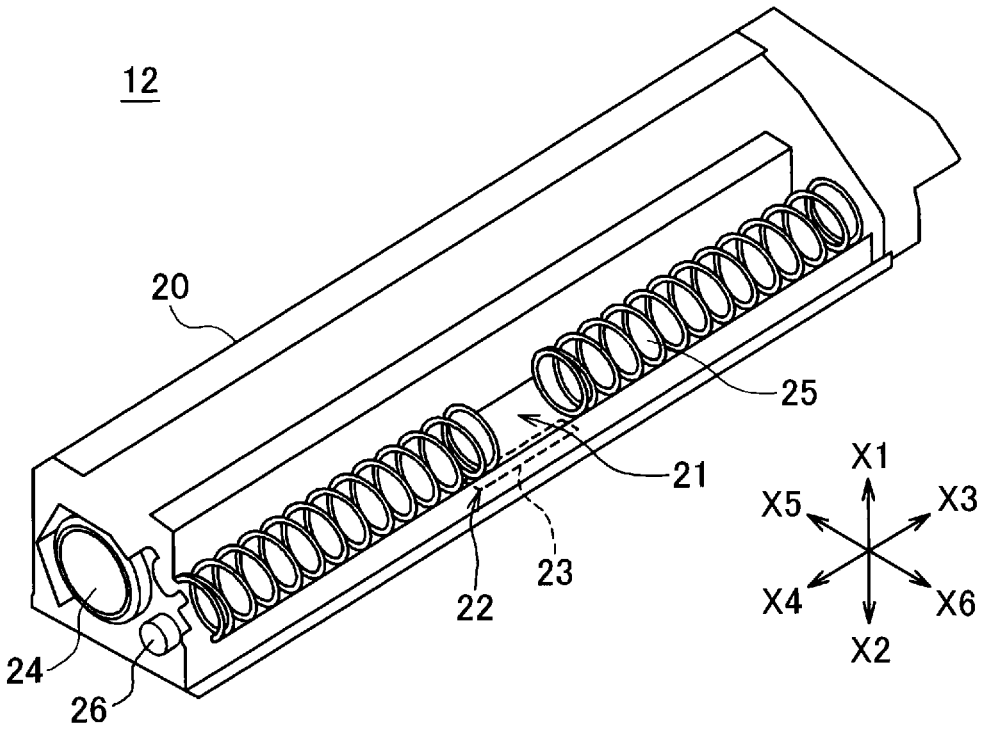
FIG. 3 is a perspective view illustrating a configuration of a developer container.

As illustrated in FIG. 3, the developer container 12 includes a container housing 20 elongated in the left-right direction. A storage chamber 21, which is a cylindrical chamber extending in the left-right direction, is formed in the container housing 20. The storage chamber 21 contains the developer. The developer container 12 may be referred to as a toner cartridge.

Substantially at a center of a bottom of the storage chamber 21 in the left-right direction, a supply opening 22 through which a space in the storage chamber 21 communicates with the external space is formed, and a shutter 23 that opens and closes the supply opening 22 is provided. The shutter 23 is connected to a lever 24, and opens or closes the supply opening 22 in accordance with rotation of the lever 24. The lever 24 is operated by a user when the developer container 12 is attached to or detached from the image forming unit 10.

For example, in a state in which the developer container 12 is not attached to the image forming unit 10 (in FIG. 2), the shutter 23 closes the supply opening 22 and prevents the developer contained in the storage chamber 21 from leaking to the outside. When the developer container 12 is attached to the image forming unit 10, the lever 24 is rotated in a predetermined opening direction, thereby moving the shutter 23 to open the supply opening 22. This makes the space in the storage chamber 21 communicate with a space in the developer supply portion 13, and the developer in the storage chamber 21 of the developer container 12 is supplied to the image forming main portion 11 through the developer supply portion 13. Also, when the developer container 12 is detached from the image forming unit 10, the lever 24 is rotated in a predetermined closing direction, thereby moving the shutter 23 to close the supply opening 22.

Also, an agitator 25 is disposed in the storage chamber 21. The agitator 25 is formed in a shape such that an elongated member is spiraled about an imaginary central axis extending in the left-right direction, and is rotatable about the imaginary central axis in the storage chamber 21. An agitator driver 26 is disposed at an end of the container housing 20. The agitator driver 26 is connected to the agitator 25. When the agitator driver 26 is supplied with a driving force from a predetermined drive source disposed in the housing 2 (see FIG. 1), it transmits the driving force to the agitator 25 and rotates the agitator 25. Thereby, the developer container 12 can agitate the developer contained in the storage chamber 21, and prevent the developer from aggregating and feed the developer to the supply opening 22.

The image forming main portion 11 (see FIG. 2) includes an image forming housing 30, a developer storage space 31, a first supply roller 32, a second supply roller 33, a developing roller 34, a developing blade 35, a photosensitive drum 36, a charging roller 37, and a cleaning blade 38. The first supply roller 32, second supply roller 33, developing roller 34, photosensitive drum 36, and charging roller 37 are each formed in a cylindrical shape having a central axis extending in the left-right direction and rotatably supported by the image forming housing 30.

In the image forming unit 10S for the special color (S), the developer container 12 containing a silver developer is attached to the image forming main portion 11 via the developer supply portion 13.

The developer storage space 31 contains the developer supplied from the developer container 12 via the developer supply portion 13. The first supply roller 32 and second supply roller 33 each includes an elastic layer that is formed by conductive urethane rubber foam or the like and forms a periphery of the roller. The developing roller 34 includes an elastic layer, a conductive surface layer, or the like forming a periphery of the roller. The developing blade 35 is formed by, for example, a stainless steel sheet having a predetermined thickness, and a part of the developing blade 35 abuts the periphery of the developing roller 34 with the developing blade 35 slightly elastically deformed.

The photosensitive drum 36 includes a thin-film charge generation layer and a thin-film charge transport layer that are sequentially formed and form a periphery of the drum, and is chargeable. The charging roller 37 includes a conductive elastic body that forms a periphery of the roller. The periphery of the charging roller 37 abuts the periphery of the photosensitive drum 36. The cleaning blade 38 is formed by, for example, a thin-plate-shaped resin member, and a part of the cleaning blade 38 abuts the periphery of the photosensitive drum 36 with the cleaning blade 38 slightly elastically deformed.

The LED head 14 is located above the photosensitive drum 36 in the image forming main portion 11. The LED head 14 includes multiple light emitting element chips arranged linearly in the left-right direction, and causes light emitting elements of the light emitting element chips to emit light in a light emitting pattern based on an image data signal supplied from the controller 3 (see FIG. 1).

The image forming main portion 11 is supplied with a driving force from a motor (not illustrated), thereby rotating the first supply roller 32, second supply roller 33, developing roller 34, and charging roller 37 in the direction of arrow R1 (clockwise in FIG. 2) and rotating the photosensitive drum 36 in the direction of arrow R2 (counterclockwise in FIG. 2). Further, the image forming main portion 11 applies respective predetermined bias voltages to the first supply roller 32, second supply roller 33, developing roller 34, developing blade 35, and charging roller 37, thereby charging them.

Each of the first supply roller 32 and second supply roller 33 is charged to cause the developer in the developer storage space 31 to adhere to its periphery, and is rotated to apply the developer to the periphery of the developing roller 34. The developing blade 35 removes excess developer from the periphery of the developing roller 34 to form a thin layer of developer on the periphery. The periphery of the developing roller 34 with the thin layer of developer formed thereon is brought into contact with the periphery of the photosensitive drum 36.

The charging roller 37 abuts the photosensitive drum 36 while being charged, thereby uniformly charging the periphery of the photosensitive drum 36. The LED head 14 emits light at predetermined time intervals in a light emitting pattern based on an image data signal supplied from the controller 3 (see FIG. 1), thereby sequentially exposing the photosensitive drum 36. Thereby, an electrostatic latent image is sequentially formed on the periphery of the photosensitive drum 36, in the vicinity of the upper end of the photosensitive drum 36.

Then, rotation of the photosensitive drum 36 in the direction of arrow R2 brings the part with the electrostatic latent image formed thereon into contact with the developing roller 34. Thereby, developer adheres to the periphery of the photosensitive drum 36 based on the electrostatic latent image, thereby forming a developer image based on the image data. Further, rotation of the photosensitive drum 36 in the direction of arrow R2 brings the developer image to the vicinity of the lower end of the photosensitive drum 36.

An intermediate transfer unit 40 is disposed below the image forming units 10 in the housing 2 (see FIG. 1). The intermediate transfer unit 40 includes a drive roller 41, a driven roller 42, a backup roller 43, an intermediate transfer belt 44, five primary transfer rollers 45, a secondary transfer roller 46, and a reverse bending roller 47. The drive roller 41, driven roller 42, backup roller 43, primary transfer rollers 45, secondary transfer roller 46, and reverse bending roller 47 are each formed in a cylindrical shape having a central axis extending in the left-right direction and rotatably supported by the housing 2.

The drive roller 41 is disposed behind and below the image forming unit 10S, and rotates in the direction of arrow R1 when being supplied with a driving force from a belt motor (not illustrated). The driven roller 42 is disposed in front of and below the image forming unit 10K. The upper ends of the drive roller 41 and driven roller 42 are located at the same level as or slightly below the lower ends of the photosensitive drums 36 (see FIG. 2) of the respective image forming units 10. The backup roller 43 is disposed in front of and below the drive roller 41 and behind and below the driven roller 42.

The intermediate transfer belt 44 is an endless belt formed by a high-resistance plastic film, and is stretched around the drive roller 41, driven roller 42, and backup roller 43. Further, in the intermediate transfer unit 40, the five primary transfer rollers 45 are disposed under a part of the intermediate transfer belt 44 stretched between the drive roller 41 and the driven roller 42, more specifically, at positions directly under the five image forming units 10 and facing the photosensitive drums 36 with the intermediate transfer belt 44 therebetween. The primary transfer rollers 45 are applied with predetermined bias voltages.

The secondary transfer roller 46 is located directly under the backup roller 43 and urged toward the backup roller 43. Thus, in the intermediate transfer unit 40, the intermediate transfer belt 44 is sandwiched between the secondary transfer roller 46 and the backup roller 43. Also, the secondary transfer roller 46 is applied with a predetermined bias voltage. Hereinafter, the secondary transfer roller 46 and backup roller 43 will be collectively referred to as a secondary transfer unit 49.

The reverse bending roller 47 is located in front of and below the drive roller 41 and above and behind the backup roller 43, and urges the intermediate transfer belt 44 forward and upward. Thereby, the intermediate transfer belt 44 is tightly stretched around the rollers. Also, a reverse bending backup roller 48 is disposed in front of and above the reverse bending roller 47 with the intermediate transfer belt 44 therebetween.

The intermediate transfer unit 40 rotates the drive roller 41 in the direction of arrow R1 with a driving force supplied from the belt motor (not illustrated), thereby moving the intermediate transfer belt 44 in a direction along arrow E1. Also, each primary transfer roller 45 rotates in the direction of arrow R1 while being applied with a predetermined bias voltage. Thereby, the image forming units 10 can transfer, onto the intermediate transfer belt 44, the developer images that have been brought to the vicinities of the lower ends of the peripheries of the photosensitive drums 36 (see FIG. 2) and sequentially superimpose the developer images of the respective colors. At this time, the developer images of the respective colors are superimposed on a surface of the intermediate transfer belt 44 sequentially from the developer image of silver (S) on the upstream side. The intermediate transfer unit 40 moves the intermediate transfer belt 44 to convey the developer images transferred from the respective image forming units 10 to the vicinity of the backup roller 43.

A conveying path W, which is a path for conveying the sheet P, is formed in the housing 2 (see FIG. 1). The conveying path W extends forward and upward from the front side of the lower end of the housing 2, makes a half turn, and extends rearward under the intermediate transfer unit 40. Then, the conveying path W extends upward behind the intermediate transfer unit 40 and image forming unit 10S, and extends forward. Thus, the conveying path W is formed in an S-shape in FIG. 1. In the housing 2, various components are disposed along the conveying path W.

A first sheet feeder 50 is disposed in the housing 2 near the lower end of the housing (see FIG. 1). The first sheet feeder 50 includes a sheet cassette 51, a pickup roller 52, a feed roller 53, a retard roller 54, a conveying guide 55, pairs of conveying rollers 56, 57, and 58, and the like. The pickup roller 52, the feed roller 53, the retard roller 54, and the conveying rollers of the pairs 56, 57, and 58 are each formed in a cylindrical shape having a central axis extending in the left-right direction.

The sheet cassette 51 is formed in a hollow rectangular parallelepiped shape, and contains sheets P in a state in which the sheets P are stacked with their surfaces facing in the up-down direction, or in a stacked state. Also, the sheet cassette 51 is attachable to and detachable from the housing 2.

The pickup roller 52 abuts the uppermost surface of the sheets P contained in the sheet cassette 51, near the front end of the uppermost surface. The feed roller 53 is disposed in front of and at a distance from the pickup roller 52. The retard roller 54 is located under the feed roller 53 and forms a gap corresponding to the thickness of a sheet P between the retard roller 54 and the feed roller 53.

When the first sheet feeder 50 is supplied with a driving force from a sheet feed motor (not illustrated), it rotates or stops the pickup roller 52, feed roller 53, and retard roller 54 as appropriate. Thereby, the pickup roller 52 feeds forward one or more uppermost sheets of the sheets P contained in the sheet cassette 51. The feed roller 53 and retard roller 54 further feed forward the uppermost sheet of the sheets P while stopping the other sheets. In this manner, the first sheet feeder 50 separates and feeds forward the sheets P one by one.

The conveying guide 55 is disposed in a front lower part of the conveying path W, and allows the sheet P to move forward and upward and further move rearward and upward along the conveying path W. The pair of conveying roller 56 is disposed near a center of the conveying guide 55. The pair of conveying roller 57 is disposed near an upper end of the conveying guide 55. The pairs of conveying rollers 56 and 57 are supplied with driving forces from the sheet feed motor (not illustrated) to rotate in predetermined directions. Thereby, the pairs of conveying rollers 56 and 57 convey the sheet P along the conveying path W.

Also, a second sheet feeder 60 is disposed in front of the pair of conveying rollers 57 in the housing 2. The second sheet feeder 60 includes a sheet tray 61, a pickup roller 62, a feed roller 63, a retard roller 64, and the like. The sheet tray 61 is formed in the shape of a plate that is thin in the up-down direction, and has sheets P2 placed thereon. The sheets P2 placed on the sheet tray 61 are, for example, sheets different in size or quality from the sheets P contained in the sheet cassette 51.

The pickup roller 62, feed roller 63, and retard roller 64 are configured in the same manner as the pickup roller 52, feed roller 53, and retard roller 54 of the first sheet feeder 50, respectively. When the second sheet feeder 60 is supplied with a driving force from the sheet feed motor (not illustrated), it rotates and stops the pickup roller 62, feed roller 63, and retard roller 64 as appropriate, thereby feeding rearward the uppermost sheet of the sheets P2 on the sheet tray 61 while stopping the other sheets. In this manner, the second sheet feeder 60 separates and feeds rearward the sheets P2 one by one. The sheet P2 fed at this time is conveyed by the pair of conveying rollers 57 along the conveying path W similarly to the sheet P. Hereinafter, for convenience of description, sheets P2 will be simply referred to as sheets P without distinguishing sheets P2 from sheets P.

The rotation of the pair of conveying rollers 57 is controlled as appropriate. Thereby, the pair of conveying rollers 57 applies a frictional force to the sheet P to correct inclination of the sides of the sheet P relative to the moving direction, i.e., skew of the sheet P, and place the sheet P in a state in which leading and trailing edges of the sheet P are along the left-right direction, and then feeds the sheet P rearward. The pair of conveying rollers 58 is located behind and at a predetermined distance from the pair of conveying rollers 57. The pair of conveying rollers 58 rotates similarly to the pair of conveying rollers 56 and the like, thereby applying a driving force to the sheet P conveyed along the conveying path W and further conveying the sheet P rearward along the conveying path W.

The secondary transfer unit 49, i.e., the backup roller 43 and secondary transfer roller 46, of the intermediate transfer unit 40 is disposed behind the pair of conveying rollers 58. In the secondary transfer unit 49, the developer images that have been formed by the image forming units 10 and transferred onto the intermediate transfer belt 44 approach the conveying path W with the movement of the intermediate transfer belt 44, and the secondary transfer roller 46 is applied with a predetermined bias voltage. Thus, the secondary transfer unit 49 transfers the developer images from the intermediate transfer belt 44 to the sheet P conveyed along the conveying path W and conveys the sheet P further rearward.

A fixing unit 70 is disposed behind the secondary transfer unit 49. The fixing unit 70 is constituted by a heating unit 71 and a pressure unit 72 that face each other with the conveying path W therebetween. The heating unit 71 includes a heating belt that is an endless belt, and components, such as a heater and multiple rollers, disposed inside the heating belt. The pressure unit 72 is formed in a cylindrical shape having a central axis extending in the left-right direction, and presses its upper surface against a lower surface of the heating unit 71 to form a nip portion.

The fixing unit 70 heats the heater of the heating unit 71 to a predetermined temperature and rotates a roller as appropriate to rotate the heating belt in the direction of arrow R1, and rotates the pressure unit 72 in the direction of arrow R2, under control of the controller 3. In this state, when the fixing unit 70 receives the sheet P on which the developer images have been transferred by the secondary transfer unit 49, it nips the sheet P with the heating unit 71 and pressure unit 72, fixes the developer images to the sheet P by applying heat and pressure, and feeds it rearward.

A pair of conveying rollers 74 is disposed behind the fixing unit 70, and a switch 75 is disposed behind the pair of conveying rollers 74. The switch 75 switches the traveling direction of the sheet P to an upward direction or a downward direction, under control of the controller 3. A sheet discharge unit 80 is disposed above the switch 75. The sheet discharge unit 80 includes a conveying guide 81 that guides the sheet P upward along the conveying path W, pairs of conveying rollers 82, 83, 84, and 85 facing each other with the conveying path W therebetween, and the like.

A reconveying unit 90 is disposed below the switch 75, fixing unit 70, secondary transfer unit 49, and the like. The reconveying unit 90 includes a conveying guide and pairs of conveying rollers (not illustrated) that form a reconveying path U, and the like. The reconveying path U extends downward from below the switch 75, extends forward, and then joins the conveying path W on the downstream side of the pair of conveying rollers 57.

When the sheet P is discharged, the controller 3 switches the traveling direction of the sheet P to a direction toward the sheet discharge unit 80, which is the upward direction, by means of the switch 75. The sheet discharge unit 80 conveys the sheet P received from the switch 75 upward, and discharges it to a sheet discharge tray 2T through an outlet 86. Also, when the sheet P is returned, the controller 3 switches the traveling direction of the sheet P to a direction toward the reconveying unit 90, which is the downward direction, by means of the switch 75. The reconveying unit 90 conveys the sheet P received from the switch 75 along the reconveying path U to the downstream side of the pair of conveying rollers 57 and causes the sheet P to be reconveyed along the conveying path W. Thereby, the sheet P is inverted and returned to the conveying path W, which allows the image forming apparatus 1 to perform duplex printing.

As described above, the image forming apparatus 1 forms developer images using the developers in the image forming units 10, transfers the developer images onto the intermediate transfer belt 44, transfers the developer images from the intermediate transfer belt 44 onto a sheet P in the secondary transfer unit 49, and fixes the developer images in the fixing unit 70, thereby printing (or forming) an image on the sheet P.

<2. Production of Developer>

Next, production of the developers contained in the developer containers 12 of the image forming units 10 (see FIG. 2) will be described. In this embodiment, production of the silver developer will be described especially.

In general, developer contains a pigment for exhibiting a desired color, a binder resin for binding the pigment to a medium, such as a sheet P, an external additive for improving the chargeability, and the like. Hereinafter, for convenience of description, a particle containing a pigment and a binder resin will be referred to as a toner base particle (or toner particle), and powder containing toner base particles will be referred to as developer D. Developer D may contain an external additive or the like. Developer D is also referred to as toner.

Different types of developers D having different configurations and properties were produced by varying the production conditions. Hereinafter, developers D produced in Example 1, Example 2, Comparative Example 1, and Comparative Example 2 will be referred to as developers Da, Db, Dc, and Dd, respectively.

<2-1. Example 1>

In Example 1, an aqueous medium with an inorganic dispersant dispersed therein was first prepared. Specifically, 920 parts by weight of industrial trisodium phosphate dodecahydrate was mixed with 27000 parts by weight of pure water, and dissolved therein at a liquid temperature of 60° C. Then, the resulting liquid was added with dilute nitric acid for pH (hydrogen-ion exponent) adjustment. The resulting aqueous solution was added with an aqueous calcium chloride solution obtained by dissolving 440 parts by weight of industrial calcium chloride anhydride in 4500 parts by weight of pure water, and was high-speed stirred with a Line Mill (manufactured by Primix Corporation) at a rotation speed of 3566 rpm for 34 minutes while being maintained at a liquid temperature of 60° C. Thereby, an aqueous phase that is an aqueous medium with a suspension stabilizer (or inorganic dispersant) dispersed therein was prepared.

Also, in Example 1, in a process of preparing a resin solution, a pigment dispersion oil medium was prepared. Specifically, a pigment dispersion liquid was prepared by mixing 395 parts by weight of a brilliant pigment (having a volume median size of 5.37 μm) and 60 parts by weight of a charge control agent (BONTRON E-84, manufactured by Orient Chemical Industries Co., Ltd.) with 7430 parts by weight of ethyl acetate, which is an organic solvent. The percentage of particles in the range of 2 to 4 μm in the volume particle size distribution (also referred to as volume distribution) of the brilliant pigment was 26.62%. The brilliant pigment contains fine aluminum (Al) flakes, or aluminum small pieces formed in flat plate shapes, flat shapes, or scale shapes. Hereinafter, the brilliant pigment will also be referred to as an aluminum pigment, a metallic pigment, or a silver toner pigment. In this case, an average particle size (also referred to as volume median size, average median size, or pigment particle size) of the brilliant pigment is preferably not less than 5 μm and not more than 20 μm. The reason thereof will be described below.

It is known that when the volume median size of a brilliant pigment is less than 5 μm, the brilliance of the developer is accordingly low, leading to low image brilliance and low image quality. On the other hand, it is known that when the volume median size of a brilliant pigment is more than 20 μm, it is difficult to include or enclose brilliant pigment particles in toner base particles, and it is difficult to form developer. Even if developer can be formed using such a brilliant pigment, it is difficult to convey the developer in an image forming apparatus, and it is difficult to properly form an image.

Then, the pigment dispersion liquid was stirred while being maintained at a liquid temperature of 60° C., and added with 60 parts by weight of a charge control resin (FCA-726N, manufactured by Fujikura Kasei Co., Ltd.), 150 parts by weight of an ester wax (WE-4, manufactured by NOF Corporation) as a release agent, and 1310 parts by weight of polyester resin as a binder resin. The mixture was stirred until solid dissolved. Thereby, an oil phase that is a pigment dispersion oil medium was prepared.

Then, the oil phase was added to the aqueous phase maintained at a liquid temperature of 60° C., and suspended by stirring for 5 minutes at a rotation speed of 900 rpm, so that particles were formed in a suspension liquid. Then, the ethyl acetate was removed by distilling the suspension liquid under reduced pressure, so that a slurry containing the particles was formed. Then, the slurry was added with nitric acid so that the pH (hydrogen-ion exponent) of the slurry was adjusted to 1.6 or lower, and was stirred. Tricalcium phosphate as a suspension stabilizer was dissolved therein, and the mixture was dehydrated, so that dehydrated particles were obtained. Then, the dehydrated particles were redispersed in pure water, stirred, and water-washed. After that, through dehydration, drying, and classification processes, toner base particles were obtained.

Then, in an external addition process, the toner base particles thus obtained were added and mixed with 1.5 wt % of small silica (AEROSIL RY200, manufactured by Nippon Aerosil Co., Ltd.), 2.29 wt % of colloidal silica (X-24-9163A, manufactured by Shin-Etsu Chemical Co., Ltd.), and 0.37 wt % of melamine particles (EPOSTAR S, manufactured by NIPPON SHOKUBAI CO., LTD.), so that developer Da was obtained.

<2-2. Example 2>

In Example 2, an aqueous medium with an inorganic dispersant dispersed therein was first prepared. Specifically, 10 parts by weight of industrial trisodium phosphate dodecahydrate was mixed with 300 parts by weight of pure water, and dissolved therein at a liquid temperature of 60° C. Then, the resulting liquid was added with dilute nitric acid for pH adjustment. The resulting aqueous solution was added with an aqueous calcium chloride solution obtained by dissolving 4.9 parts by weight of industrial calcium chloride anhydride in 50 parts by weight of pure water, and was high-speed stirred with a Line Mill (manufactured by Primix Corporation) at a rotation speed of 10000 rpm for 5 minutes while being maintained at a liquid temperature of 60° C. Thereby, an aqueous phase that is an aqueous medium with a suspension stabilizer (or inorganic dispersant) dispersed therein was prepared.

Also, in Example 2, a pigment dispersion oil medium was prepared. Specifically, a pigment dispersion liquid was prepared by mixing 4.4 parts by weight of a brilliant pigment (having a volume median size of 5.80 μm) and 0.66 parts by weight of a charge control agent (BONTRON E-84, manufactured by Orient Chemical Industries Co., Ltd.) with 82 parts by weight of ethyl acetate. The percentage of particles in the range of 2 to 4 μm in the volume distribution of the brilliant pigment was 22.85%. Then, the pigment dispersion liquid was stirred while being maintained at a liquid temperature of 60° C., and added with 0.66 parts by weight of a charge control resin (FCA-726N, manufactured by Fujikura Kasei Co., Ltd.), 1.64 parts by weight of an ester wax (WE-4, manufactured by NOF Corporation) as a release agent, and 14.55 parts by weight of polyester resin as a binder resin. The mixture was stirred until solid dissolved. Thereby, an oil phase that is a pigment dispersion oil medium was prepared.

Then, the oil phase was added to the aqueous phase maintained at a liquid temperature of 60° C., and suspended by stirring for 0.5 minutes at a rotation speed of 8000 rpm, so that particles were formed in a suspension liquid. Then, the ethyl acetate was removed by distilling the suspension liquid under reduced pressure, so that a slurry containing the particles was formed. Then, the slurry was added with nitric acid so that the pH of the slurry was adjusted to 1.6 or lower, and was stirred. Tricalcium phosphate as a suspension stabilizer was dissolved therein, and the mixture was dehydrated, so that dehydrated particles were obtained. Then, the dehydrated particles were re-dispersed in pure water, stirred, and water-washed. After that, through dehydration, drying, and classification processes, toner base particles were obtained.

Then, in an external addition process, the toner base particles thus obtained were added and mixed with 1.5 wt % of small silica (AEROSIL RY200, manufactured by Nippon Aerosil Co., Ltd.), 2.29 wt % of colloidal silica (X-24-9163A, manufactured by Shin-Etsu Chemical Co., Ltd.), and 0.37 wt % of melamine particles (EPOSTAR S, manufactured by NIPPON SHOKUBAI CO., LTD.), so that developer Db was obtained.

<2-3. Comparative Example 1>

In Comparative Example 1, developer Dc was obtained by preparing toner base particles and adding external additives thereto in the same manner as Example 1 except that a brilliant pigment having a volume median size of 8.69 μm was used and the percentage of particles in the range of 2 to 4 μm in the volume distribution of the brilliant pigment was 9.257%.

<2-4. Comparative Example 2>

In Comparative Example 2, developer Dd was obtained by preparing toner base particles and adding external additives thereto in the same manner as Example 1 except that a brilliant pigment having a volume median size of 7.101 μm was used and the percentage of particles in the range of 2 to 4 μm in the volume distribution of the brilliant pigment was 15.45%.

<3. Measurements and Comparisons of Developers>

Next, measurements and evaluations of the developers D (i.e., developers Da, Db, Dc, and Dd, which will also be referred to below as developers Da to Dd) will be described. For each developer D, a developer particle size, which is a volume median size (Dv50), a pigment particle size, which is a volume median size (Dv50), and a pigment percentage, which is the percentage of pigment particles in the range of 2 to 4 μm in the volume distribution, were measured. Here, the pigment was measured before being used in the developer D. Thus, the measurements of the pigment particle size and pigment percentage were performed on fresh pigment. Also, each developer D was evaluated in terms of surface smoothness, a specular reflection area ratio, and brilliance (or an FI value) by printing predetermined images on sheets P with the developer D by using the image forming apparatus 1 (see FIG. 1).

<3-1. Measurement of Developer Particle Size, Pigment Particle Size, and Pigment Percentage>

In this measurement, for each developer D, the volume median size (also referred to as volume average particle size) of the developer D, the volume median size (also referred to as volume average particle size) of the brilliant pigment, and the pigment percentage (also referred to as particle percentage or pigment particle percentage) that is the percentage of pigment particles in the range of 2 to 4 μm in the volume distribution of the pigment were measured by using an accurate particle size distribution analyzer (Multisizer 3, manufactured by Beckman Coulter, Inc.) under the following measurement conditions:

Aperture diameter: 100 μm

Electrolyte: ISOTON II (manufactured by Beckman Coulter, Inc.)

Dispersion liquid: a liquid obtained by dissolving NEOGEN S-20F (manufactured by DKS Co., Ltd.) in the above electrolyte and adjusting the concentration to 5%

In this measurement, 10 to 20 mg of the measurement sample was added to 5 ml of the dispersion liquid, dispersed with an ultrasonic disperser for 1 minute, added with 25 ml of the electrolyte, dispersed with the ultrasonic disperser for 5 minutes, and passed through a mesh having an opening size of 75 μm to remove aggregates, so that a sample dispersion liquid was prepared. The measurement sample was the developer D or the brilliant pigment used for the developer D.

Further, in this measurement, the sample dispersion liquid was added to 100 ml of the electrolyte, and the volume particle size distribution was obtained by measuring 30000 particles with the accurate particle size distribution analyzer. Then, in this measurement, when the sample was the developer D, the volume median size (Dv50) of the developer D was determined on the basis of the volume particle size distribution of the developer D, and when the sample was the brilliant pigment, the volume median size (Dv50) of the brilliant pigment and the pigment particle percentage (i.e., the percentage of pigment particles in the range of 2 to 4 μm in the volume distribution) were determined on the basis of the volume particle size distribution of the brilliant pigment.

The volume median size (Dv50) refers to the particle size at which the cumulative volume percentage is 50%. The accurate particle size distribution analyzer measures the particle size distribution based on the Coulter principle. The Coulter principle is a method, called aperture electrical resistance method, of measuring the volume of a particle by passing a constant current through an aperture in an electrolyte solution and measuring a change in the electrical resistance across the aperture when the particle passes through the aperture.

With this measurement, for each of developers Da to Dd, the developer particle size, pigment particle size, and pigment percentage were measured. The measurement results are shown in the table of FIG. 5. The percentages of pigment particles in the range of 2 to 4 μm in the volume distributions of the pigments of the respective developers D were 9.257 to 26.62%. FIG. 5 also shows, for each developer D, the percentage of pigment particles greater than 4 μm in the volume distribution of the pigment, and the ratio of the percentage of pigment particles in the range of 2 to 4 μm and the percentage of pigment particles greater than 4 μm.

<3-2. Evaluation of Surface Smoothness>

In this evaluation, for each of developers Da to Dd, after the developer D was put in the developer container 12 (see FIG. 2) of the image forming unit 10S corresponding to the special color of the image forming apparatus 1 (C941dn, manufactured by Oki data Corporation) (see FIG. 1), a printing process was performed in a special color white mode (using silver developer), and a surface smoothness of the printed image was evaluated. The surface smoothness was evaluated by visual evaluation of the printed image and evaluation based on a specular reflection area ratio.

Specifically, in this evaluation, an image pattern having a print image density of 100% (or an overall solid image) was printed on a coated paper (OS coated paper W, having a basis weight of 127 g/m$^2$, manufactured by Fuji Xerox Co., Ltd.) as a sheet P at a fixing temperature of 180° C. by using the image forming apparatus 1. At this time, the printing process was performed in a state in which a developing bias (which is the bias voltage applied to the developing roller 34) had been adjusted so that a luminous reflectance difference ΔY was equal to 25. The luminous reflectance difference ΔY is a difference between a luminous reflectance Y of the coated paper before printing and a luminous reflectance Y of the printed image. The luminous reflectance Y is a measure indicating brightness. In this evaluation, the luminous reflectance difference ΔY was measured by using a spectrophotometer (CM-2600d, manufactured by KONICA MINOLTA, INC.) at a measurement diameter of 8 mm.

Here, the print image density refers to a value indicating, when an image is divided into pixels, the percentage of the number of pixels at which the developer D is transferred onto the sheet P to the total number of the pixels. For example, when a solid image is printed on the entire printable area of a predetermined region (such as the outer periphery of the photosensitive drum 36 or a surface of a print medium), or when printing is performed at a coverage rate of 100%, the print image density is 100%; when an image is printed on 1% of the printable area, or when printing is performed at a coverage rate of 1%, the print image density is 1%. The print image density DPD can be expressed by the following equation (1):

$$DPD = \frac{Cm}{Cd \times CO} \times 100 \quad (1)$$

where Cd is the number of revolutions of the photosensitive drum 36, Cm is the number of dots actually used to form an image while the photosensitive drum 36 makes Cd revolutions and is the total number of dots exposed by the LED head 14 (see FIG. 2) while the image is formed, and CO is the total number of dots per revolution of the photosensitive drum 36 (see FIG. 2), i.e., the total number of dots that can be potentially used for image formation during one revolution of the photosensitive drum 36 regardless of whether they are actually exposed. In other words, CO is the total number of dots used in formation of a solid image in which the developer D is transferred onto all the pixels. Thus, the value Cd×CO represents the total number of dots that can be potentially used for image formation during Cd revolutions of the photosensitive drum 36.

<3-2-1. Visual Evaluation>

In the visual evaluation, the surface smoothness of the printed image, which was an overall solid image with a luminous reflectance difference ΔY of 25, was visually rated on a scale of 1 to 10. In this evaluation, the surface smoothness was rated as level 10 when the image quality was good, and level 1 when the image quality was the poorest. Then, the surface smoothness of the printed image was rated on a scale of "excellent", "good", and "poor". Specifically, when the printed image was uniform in density without the developer appearing granular on the printed surface and thus the image quality was excellent, the surface smoothness of the printed image was rated as level 10 and then rated as "excellent". When, although the developer appeared granular on the printed surface, the printed image was uniform in density without the granular appearance outstanding, and thus the image quality was good, the surface smoothness of the printed image was rated as level 9 and then rated as "good". When the developer appeared granular on the printed surface, the differences in density between the grains were great, the printed image appeared uneven, and thus the image quality was poor, the surface smoothness of the printed image was rated as level 8 or less and then rated as "poor". The evaluation results are shown in FIG. 5.

<3-2-2. Evaluation Based on Specular Reflection Area Ratio>

In the evaluation of the surface smoothness based on a specular reflection area ratio, the printed image, which was an overall solid image with a luminous reflectance difference ΔY of 25, was observed and captured from directly above by using a digital microscope (VH-5500, manufactured by Keyence Corporation) and a lens (VH-500, manufactured by Keyence Corporation) at a magnification of 500 times. In this evaluation, by taking advantage of the fact that when brilliant pigment is illuminated with light from directly above, it specularly reflects the light and looks white, the captured image was binarized, and the ratio of the area of the specular reflection portion (i.e., bright portion) in a predetermined region of the binarized image to the area of the predetermined region was calculated as the specular reflection area ratio. The calculation results are shown in FIG. 5.

<3-3. Evaluation of Brilliance>

In this evaluation, for each of developers Da to Dd, after the developer D was put in the developer container 12 (see FIG. 2) of the image forming unit 10S corresponding to the special color of the image forming apparatus 1 (C941dn, manufactured by Oki data Corporation) (see FIG. 1), a printing process was performed in a special color white mode (using silver developer), and a brilliance evaluation was performed.

Specifically, in this evaluation, an image pattern having a print image density of 100% (or a solid image) was printed on a coated paper (OS coated paper W, having a basis weight of 127 g/m$^2$, manufactured by Fuji Xerox Co., Ltd.) as a sheet P by using the image forming apparatus 1. At this time, the printing process was performed in a state in which the image forming apparatus 1 had been adjusted by performing an operation for setting printing conditions so that the amount of developer D deposited on the photosensitive drum 36 of the image forming unit 10S (see FIG. 2) was 1.0 mg/cm$^2$.

Figure 4:
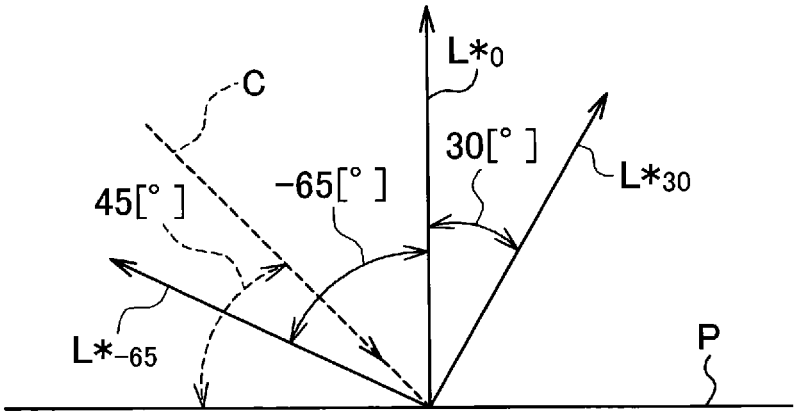
FIG. 4 is a diagram illustrating emission and reception of light by a variable angle photometer.

Then, in this evaluation, the brilliance of the printed image was measured by using a variable angle photometer (GC-5000L, manufactured by Nippon Denshoku Industries Co., Ltd.). Specifically, as illustrated in FIG. 4, with the variable angle photometer, the sheet P was illuminated with a light ray C at an angle of 45° relative to the surface of the sheet P, light reflected by the sheet P was received at angles 0°, 30°, and −65° relative to the direction perpendicular to the surface of the sheet P, and lightness indexes $L^*_0$, $L^*_{30}$, and $L^*_{-65}$ were respectively calculated from the light reception results obtained at 0°, 30°, and −65°. Then, in this evaluation, the brilliance of the image was determined by calculating a flop index FI by substituting the calculated lightness indexes into the following equation (2):

$$FI = 2.69 \times \frac{(L^*_{30} - L^*_{-65})^{1.11}}{(L^*_0)^{0.86}}. \quad (2)$$

The calculation results are shown in FIG. 5. A higher value of the flop index FI indicates a higher brilliance, and a lower value of the flop index FI indicates a lower brilliance. In this evaluation, when the flop index FI was 15 or more, it was evaluated that the printed product had metallic luster and the image brilliance was high. When the flop index FI was less than 15, it was evaluated that the printed product had low metallic luster and the image brilliance was low.

Figure 6A:
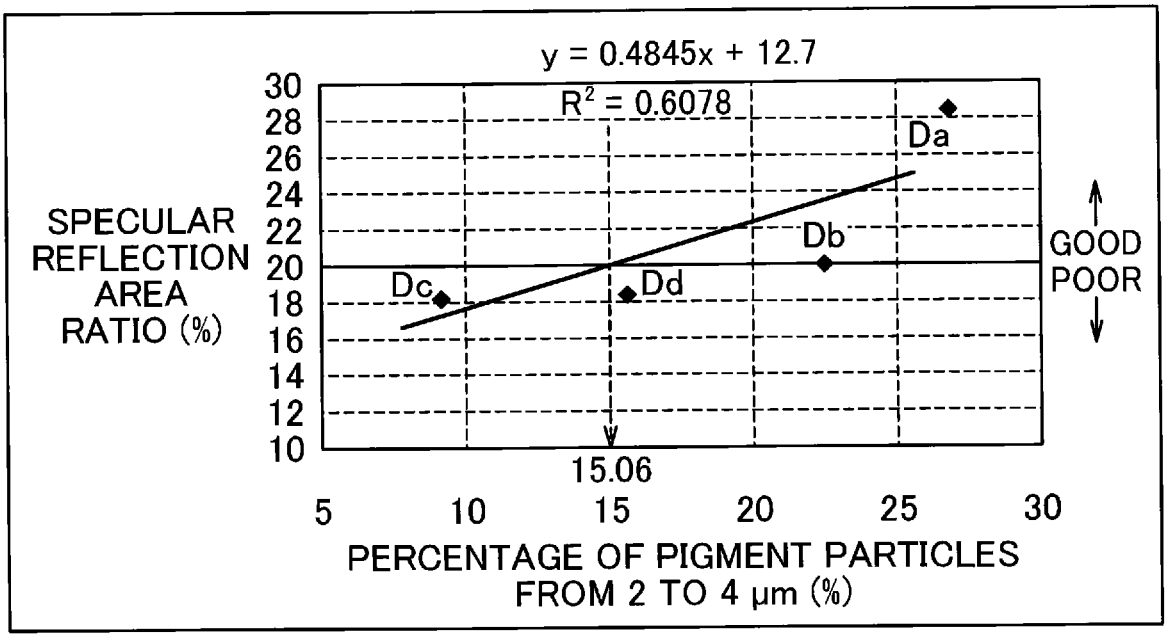
FIGS. 6A and 6B are graphs showing the results of the measurements and evaluations of the developers, FIG. 6A showing the relationship between pigment percentages and specular reflection area ratios, FIG. 6B showing the pigment percentages and FI values.
Figure 6B:
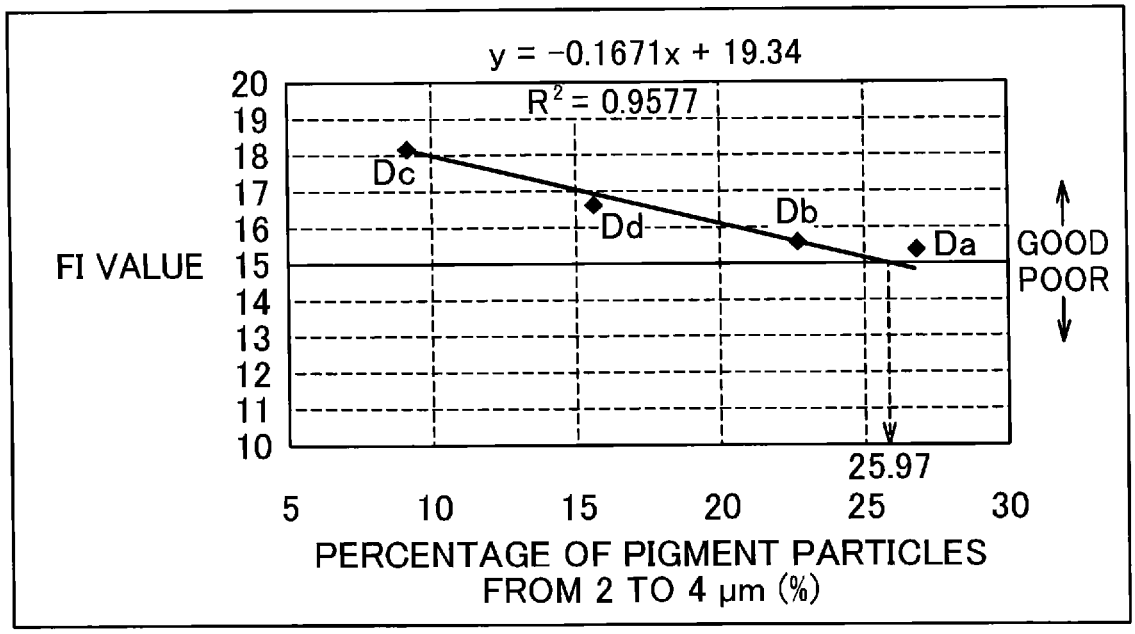

FIG. 6A shows the relationship between the pigment percentages and the specular reflection area ratios obtained by the above measurements. FIG. 6B shows the relationship between the pigment percentages and the FI values obtained by the above measurements. FIGS. 6A and 6B show that as the percentage of pigment in the range of 2 to 4 μm in the volume distribution of the pigment of the developer D increases, the specular reflection area ratio increases, but the FI value decreases.

Also, as shown in FIG. 6A, when the percentage of pigment in the range of 2 to 4 μm in the volume distribution of the brilliant pigment of the developer D is denoted by x, and the specular reflection area ratio is denoted by y, the relationship between the pigment percentage and the specular reflection area ratio is expressed by the approximation equation y=0.4845x+12.7. Also, as shown in FIG. 6B, when the percentage of pigment in the range of 2 to 4 μm in the volume distribution of the brilliant pigment of the developer D is denoted by x, and the FI value is denoted by y, the relationship between the pigment percentage and the FI value is expressed by the approximation equation y=−0.1671x+19.34. A threshold for the FI value was 15, and a threshold for the specular reflection area ratio was 20%.

<4. Measurements and Comparisons of Developers after External Additive Removal>

Next, measurements of residues obtained by dissolving the developers D (i.e., developers Da, Db, Dc, and Dd, which will also be referred to below as developers Da to Dd) in tetrahydrofuran (THF) will be described. For each developer D, pigment was extracted from the developer D, and a particle size, which is a volume median size (Dv50), of the extracted pigment and a pigment percentage of the extracted pigment that is the percentage of pigment particles in the range of 2 to 4 μm in the volume distribution of the extracted pigment were measured.

<4-1. Procedure of Removal of External Additive>

In this measurement, for each of the developers D (i.e., developers Da to Dd), the external additive was removed from the developer D by the following removal process.

In the removal process, a non-ionic surfactant is first added to pure water, and then dispersed in the pure water by stirring the mixture while heating it. The non-ionic surfactant is, for example, polyoxyethylene alkyl ether or the like. Thereby, an aqueous surfactant solution is obtained. Conditions, such as the heating temperature and stirring time, can be arbitrarily set. Also, as the surfactant, a 5% aqueous solution of EMULGEN (manufactured by Kao Corporation) or the like may be used, for example.

Then, in the removal process, 100 ml (=$cm^3$) of the aqueous surfactant solution is put into a beaker containing 2 g of the developer (to be processed), and stirred for 40 minutes while being maintained at a liquid temperature of 25° C. Further, in the removal process, the beaker is placed in a water bath, and then the water bath (at a temperature of 38° C.) is vibrated for 40 minutes by using an ultrasonic vibrator.

Then, in the removal process, the residue is collected by suction filtration of the aqueous surfactant solution. Then, in the removal process, the residue is sufficiently washed and then dried.

Thereby, the external additive is removed from the developer, and a developer after external additive removal, which is the dried residue, is obtained.

Then, to check whether the external additive has been sufficiently removed from the developer, the content rate of a specific element contained in the developer after external additive removal is measured by using one or more types of elemental analyzers. For example, when silica is used as the external additive, the specific element is silicon (Si). In the removal process, the content rate of silicon remaining in the developer after external additive removal is measured by using an energy dispersive X-ray fluorescence spectrometer (EDX-800HS, manufactured by Shimadzu Corporation).

In general, when a sample is irradiated with X-rays, the sample generates and emits fluorescent X-rays that are X-rays unique to atoms contained in the sample. The fluorescent X-rays have wavelengths (energies) unique to the respective elements. Thus, qualitative analysis can be performed by determining the wavelengths of the fluorescent X-rays. Also, the intensity of fluorescent X-rays from an element is a function of the concentration of the element. Thus, quantitative analysis can be performed by measuring the amount of X-rays for each of the wavelengths unique to the elements.

Based on the above principle, by using the energy dispersive X-ray fluorescence spectrometer, the developer after external additive removal is irradiated with X-rays emitted from an X-ray tube, and the content of silicon (Si) in the developer after external additive removal is determined on the basis of fluorescent X-rays emitted from atoms of silicon (Si) contained in the developer after external additive removal. The silicon content is expressed as a volume percentage of silicon (Si) in the developer after external additive removal. The energy dispersive X-ray fluorescence spectrometer is used under the following conditions:

Atmosphere: Helium replacement measurement

X-ray tube voltage: 15 kV, 50 kV

When the difference between the measured content of the specific element and the content of the specific element in the developer before external additive addition is not more than 0.21%, it is determined that the external additive has been almost completely removed from the developer. When the difference of the content of the specific element is more than 0.21%, since the external additive removal is insufficient, the above-described removal process is repeated until the difference of the content of the specific element becomes not more than 0.21%.

For each of developers Da to Dd, the above removal process was repeated two times. Thereby, the external additive was removed from each of developers Da to Dd, so that developers D1*a*, D1*b*, D1*c*, and D1*d* after external additive removal, which were dried residues, were obtained. Hereinafter, developers D1*a* to D1*d* after external additive removal will also be collectively referred to as developers D1 after external additive removal. However, for developer Dd, the silicon content measurement was not performed.

FIG. 7 shows, for each of developers Da to Dc, the silicon content in the developer before external additive addition, the silicon content measured in the first removal process, the silicon content measured in the second removal process, and the difference between the silicon content measured in the second removal process and the silicon content in the developer before external additive addition. FIG. 7 shows that for each of developers Da to Dc, the difference of the content of the specific element was not more than 0.21%, and thus the external additive was successfully removed by the above removal process.

<4-2. Method of Extracting Brilliant Pigment>

Then, for each of the developers after external additive removal, the brilliant pigment was extracted from the developer by the following pigment extracting process.

In the pigment extracting process, first, 100 g of tetrahydrofuran is put into a beaker containing 1 g of the developer after external additive removal, and stirred for 60 minutes at a rotation speed of 340 rpm while being maintained at a liquid temperature of 60° C. Then, in the pigment extracting process, the residue is collected by suction filtration of the tetrahydrofuran.

Then, in the pigment extracting process, the residue is put into a beaker, and 100 g of tetrahydrofuran is put into the beaker and stirred for 90 minutes at a rotation speed of 340 rpm while being maintained at a liquid temperature of 60° C. Then, in the pigment extracting process, the residue is collected by suction filtration of the tetrahydrofuran.

Then, in the pigment extracting process, the residue is put into a beaker, and 100 g of tetrahydrofuran is put into the beaker and stirred for 180 minutes at a rotation speed of 340 rpm while being maintained at a liquid temperature of 60° C. Then, in the pigment extracting process, the residue is collected by suction filtration of the tetrahydrofuran.

Then, in the pigment extracting process, the residue is put into a beaker, and 100 g of tetrahydrofuran is put into the beaker and stirred for 240 minutes at a rotation speed of 340 rpm while being maintained at a liquid temperature of 60° C. Then, in the pigment extracting process, the residue is collected by suction filtration of the tetrahydrofuran.

Then, in the pigment extracting process, the residue is put into a beaker, and 100 g of tetrahydrofuran is put into the beaker and stirred for 180 minutes at a rotation speed of 340 rpm while being maintained at a liquid temperature of 60° C. Then, in the pigment extracting process, the residue, which is metallic pigment, is collected by suction filtration of the tetrahydrofuran.

<4-3. Measurements of Volume Median Size and Pigment Percentage>

For each of the residues, which were metallic pigments, extracted from the developers D (i.e., developers Da to Dd) by the above method, a volume median size (also referred to as volume average particle size) of the residue and the percentage of pigment in the range of 2 to 4 μm in the volume distribution of the residue were measured by using the accurate particle size distribution analyzer (Multisizer 3, manufactured by Beckman Coulter, Inc.). The measurement results are shown in the table of FIG. 8. FIG. 8 shows that the percentages of pigment particles in the range of 2 to 4 μm in the volume distributions of the residues (i.e., metallic pigments) extracted from the respective developers D were 7.817 to 25.3%. FIG. 8 also shows, for each developer D, the percentage of pigment particles greater than 4 μm in the volume distribution of the residue, and the ratio of the percentage of pigment particles in the range of 2 to 4 μm and the percentage of pigment particles greater than 4 μm.

Figure 9:
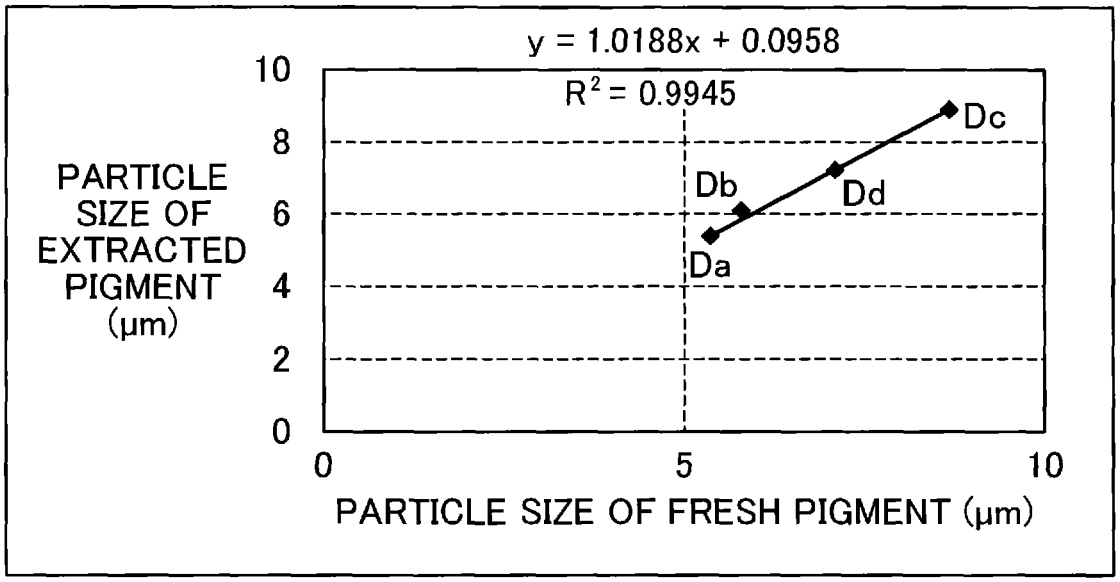
FIG. 9 is a graph showing the results of the measurements of the metallic pigments extracted from the developers.
Figure 10:
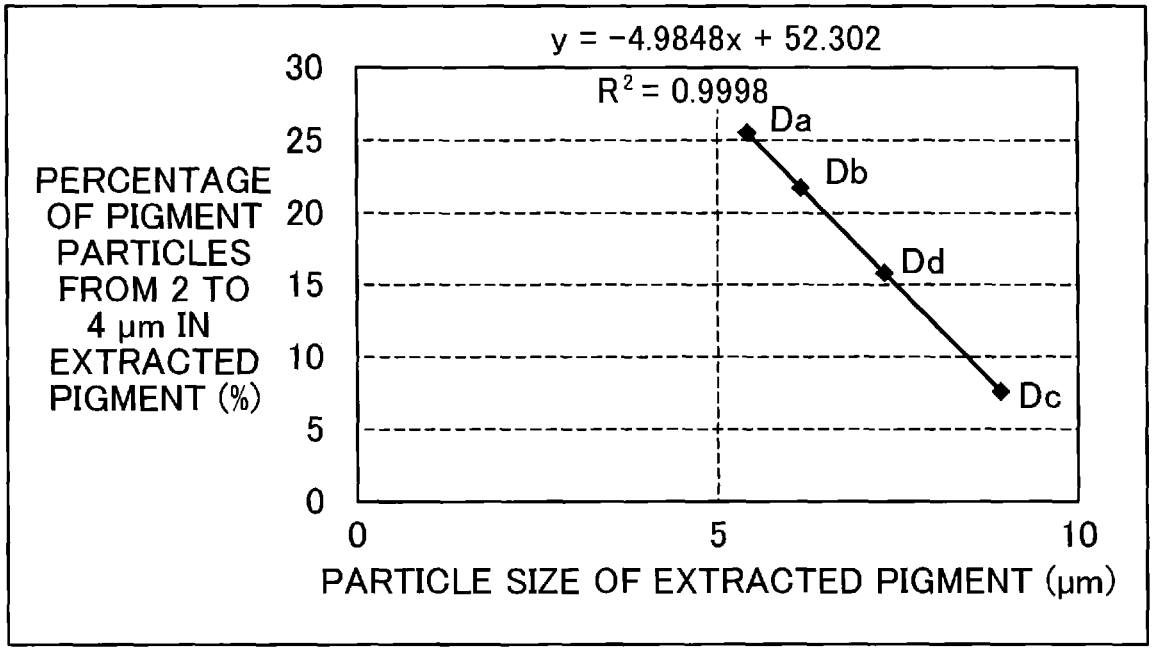
FIG. 10 is another graph showing the results of the measurements of the metallic pigments extracted from the developers.

FIG. 9 shows the relationship between the pigment particle sizes and the particle sizes of the extracted pigments, which were obtained by the above-described measurements. FIG. 10 shows the relationship between the particle sizes of the extracted pigments and the percentages of pigment in the range of 2 to 4 μm in the volume distributions of the extracted pigments, which were obtained by the above-described measurements.

Figure 11A:
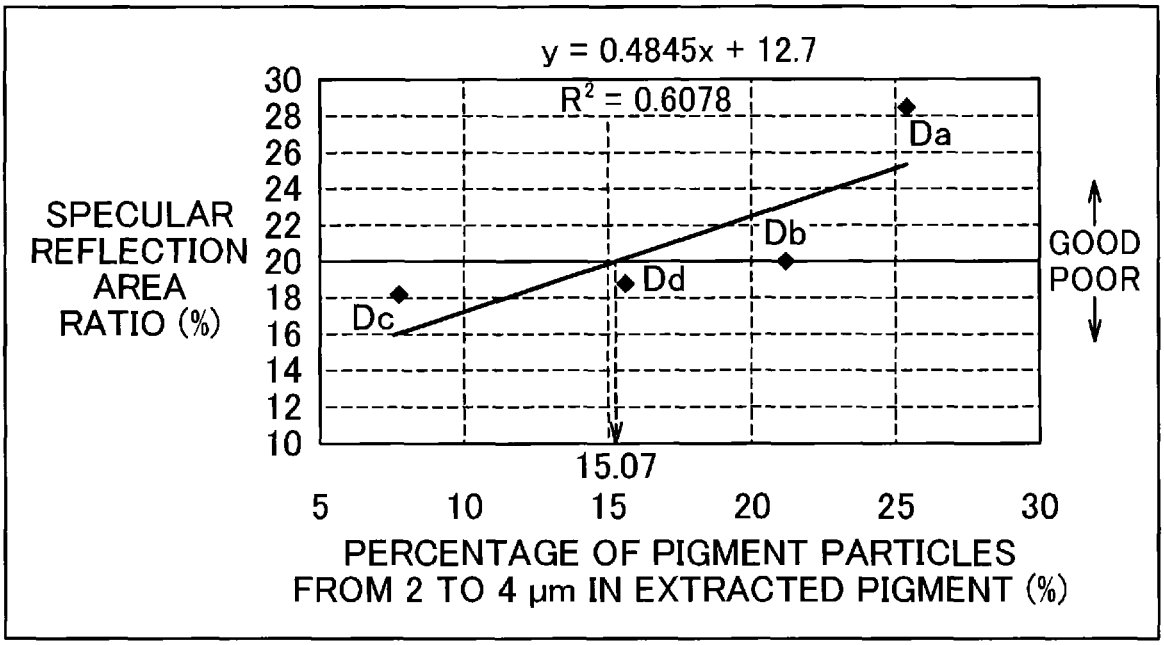
FIGS. 11A and 11B are graphs showing the results of the measurements and evaluations, FIG. 11A showing the relationship between percentages of extracted pigments and the specular reflection area ratios, FIG. 11B showing the relationship between the percentages of extracted pigments and the FI values.
Figure 11B:
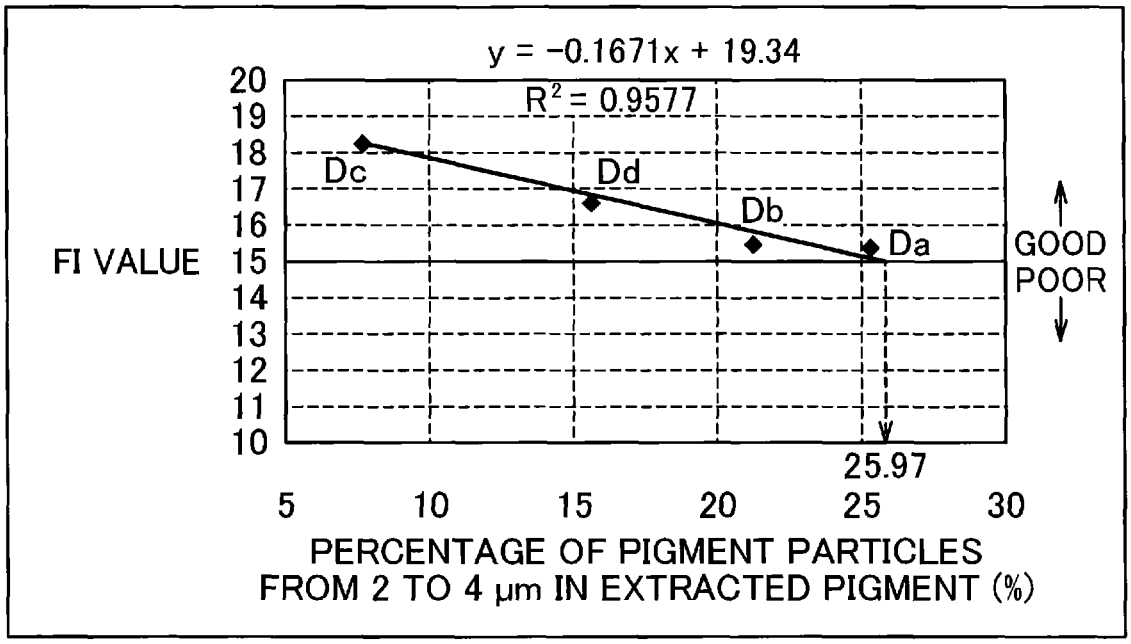

FIG. 11A shows the relationship between the percentages of the extracted pigments and the specular reflection area ratios, which were obtained by the above-described measurements. FIG. 11B shows the relationship between the percentages of the extracted pigments and the FI values, which were obtained by the above-described measurements. FIGS. 11A and 11B show that as the percentage of pigment in the range of 2 to 4 μm in the volume distribution of the residue extracted from the developer D increases, the specular reflection area ratio increases, but the FI value decreases.

As shown in FIG. 11A, when the percentage of pigment in the range of 2 to 4 μm in the volume distribution of the brilliant pigment of the developer after external additive removal is denoted by x and the specular reflection area ratio is denoted by y, the relationship between the percentage of the pigment and the specular reflection area ratio is expressed by the approximation equation $y=0.4845x+12.7$. Also, as shown in FIG. 11B, when the percentage of pigment in the range of 2 to 4 μm in the volume distribution of the brilliant pigment of the developer after external additive removal is denoted by x and the FI value is denoted by y, the relationship between the percentage of the pigment and the FI value is expressed by the approximation equation $y=-0.1671x+19.34$. A threshold for the FI value was 15, and a threshold for the specular reflection area ratio was 20%.

Here, a half-width of the volume distribution (or volume particle size distribution) of the extracted metallic pigment (or silver toner pigment) was 4.90797 μm for developer Da, 8.8648 μm for developer Db, and 8.6515 μm for developer Dc.

<5. Determination of Percentage of Particles in Brilliant Pigment Based on Measurements and Evaluations>

Figure 12:
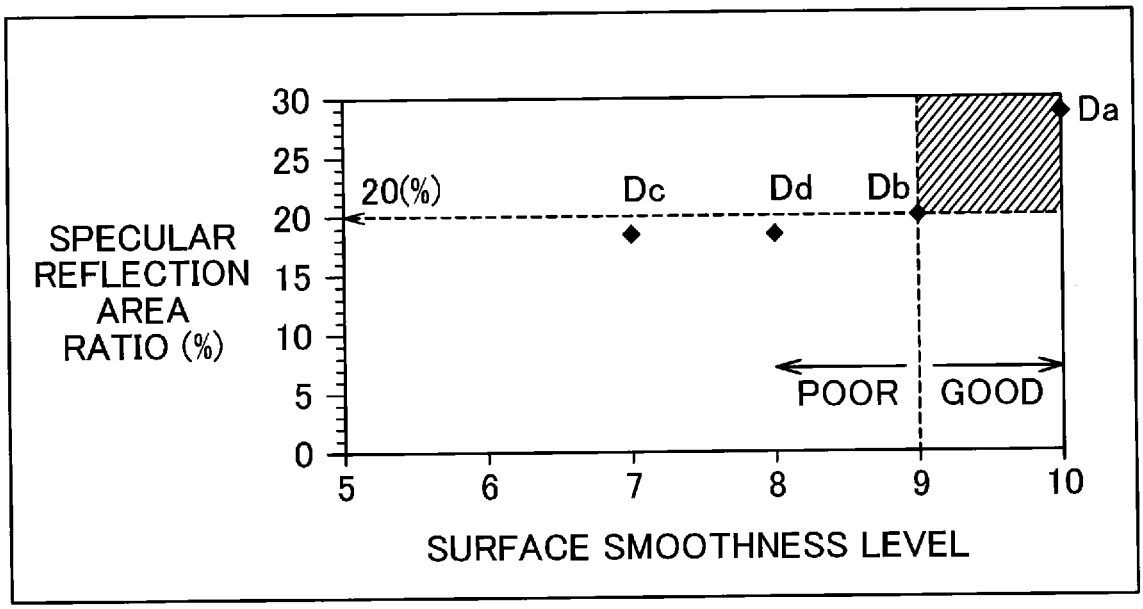
FIG. 12 is a graph showing the relationship between surface smoothness levels and the specular reflection area ratios.
Figure 13:
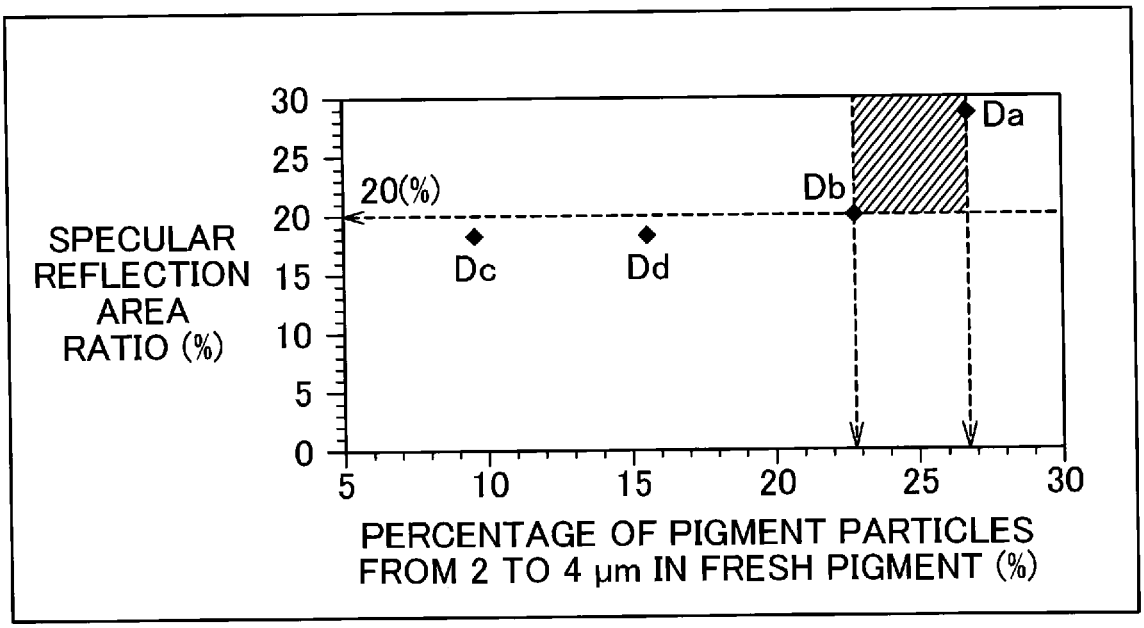
FIG. 13 is a graph showing the relationship between the pigment percentages and the specular reflection area ratios.

Next, based on the results of the measurements and evaluations (see FIGS. 5, 6A, 6B, 8, 11A, and 11B), a condition of the percentage of particles in the range of 2 to 4 μm in the volume distribution of the brilliant pigment for the developer D and a condition of the percentage of particles in the range of 2 to 4 μm in the volume distribution of the brilliant pigment extracted from the developer D are determined. FIG. 12 shows the relationship between the surface smoothness levels and the specular reflection area ratios, which were obtained by the above-described evaluations. FIG. 13 shows the relationship between the pigment percentages and the specular reflection area ratios, which were obtained by the above-described measurements. As shown in FIG. 12, at the same density, as the surface smoothness level increases, the specular reflection area ratio also increases. When the surface smoothness level is not less than 9, the specular reflection area ratio is not less than 20% (see the hatched area in FIG. 12). As shown in FIG. 13, at the same density, as the pigment percentage increases, the specular reflection area ratio also increases. When the pigment percentage is not less than 22.85% and not more than 26.62%, the specular reflection area ratio is not less than 20% (see the hatched area in FIG. 13).

Specifically, in this embodiment, developer Dc of Comparative Example 1 and developer Dd of Comparative Example 2, which were rated low in terms of the surface smoothness and specular reflection area ratio, are eliminated, and developer Da of Example 1 and developer Db of Example 2, which were rated high in terms of the surface smoothness and specular reflection area ratio and which were also rated high in terms of the brilliance (i.e., whose FI values were not less than 15), are employed.

Accordingly, the condition of the percentage of powder in the range of 2 to 4 μm in the volume particle size distribution of the brilliant pigment for the developer D, that is, the condition of the percentage of brilliant pigment in the range of 2 to 4 μm in the volume distribution of the brilliant pigment for the developer D, is set to a range including the values of the pigment percentages of developers Da and Db and excluding the values of the pigment percentages of developers Dc and Dd. Specifically, from the values of FIG. 5, the pigment percentage of the pigment for the developer D is required to be not less than 22.85% and not more than 26.62%.

Also, regarding developers Da and Db, from the values of FIG. 8, the percentage of the pigment extracted from the developer after external additive removal is required to be not less than 21.5% and not more than 25.3%. Further, as shown in FIG. 8, the volume median sizes of the pigments extracted from developers Da and Db were not less than 5.44 μm and not more than 6.15 μm.

<6. Advantages and the Like>

The image forming apparatus 1 (see FIG. 1) according to this embodiment includes the image forming unit 10S including the developer container 12 (see FIG. 2) containing the silver developer D having brilliance, and thereby can represent a brilliant silver color in an image printed on a sheet P. In this embodiment, the developer D is produced by using a brilliant pigment containing fine aluminum (Al) flakes.

The evaluation results of Comparative examples 1 and 2 show that when the percentage of particles in the range of 2 to 4 μm in the volume distribution of the brilliant pigment for the developer D is low, such as not less than 9.257% and not more than 15.45%, and when the percentage of particles in the range of 2 to 4 μm in the volume distribution of the brilliant pigment in the developer after external additive removal is low, such as not less than 7.817% and not more than 15.762%, the FI value is not less than 15 and thus excellent, but the specular reflection area ratio is less than 20% and thus poor. On the other hand, the evaluation results of Examples 1 and 2 show that when the percentage of particles in the range of 2 to 4 μm in the volume distribution of the brilliant pigment for the developer D is not less than 22.85% and not more than 26.62%, and when the percentage of particles in the range of 2 to 4 μm in the volume distribution of the brilliant pigment in the developer after external additive removal is not less than 21.5% and not more than 25.3%, good results are obtained in all of the visual evaluation, the evaluation based on the specular reflection area ratio, and the brilliance evaluation.

Based on the above, in this embodiment, for the developer D, a condition is set to permit developers Da and Db, which were rated high in all of the visual evaluation, the evaluation based on the specular reflection area ratio, and the brilliance evaluation, and exclude developers Dc and Dd. Specifically, the percentage of particles in the range of 2 to 4 μm in the volume distribution of the brilliant pigment for the developer D is required to be not less than 22.85% and not more than 26.62%, and the percentage of particles in the range of 2 to 4 μm in the volume distribution of the brilliant pigment in the developer after external additive removal is required to be not less than 21.5% and not more than 25.3%. This makes the specular reflection area ratio not less than 20%, improves concealment by the brilliant pigment on a printed medium, and allows the image forming apparatus 1 to provide a printed image with improved surface smoothness.

A reason why the surface smoothness of the printed image is improved is because, by increasing the percentage of particles in the range of 2 to 4 μm in the volume distribution of the brilliant pigment for the developer D to the range of not less than 22.85% and not more than 26.62% and increasing the percentage of particles in the range of 2 to 4 μm in the volume distribution of the brilliant pigment in the developer after external additive removal to the range of not less than 21.5% and not more than 25.3%, it is possible to increase the number of pigment particles per unit volume, distribute the pigment particles more uniformly in the brilliant developer, and cover a print medium with brilliant pigment more uniformly. The specular reflection area ratio at this time is not less than 20%.

Also, a reason why the upper limit of the percentage of particles in the range of 2 to 4 μm in the volume distribution of the brilliant pigment for the developer D is set at 26.62% is because a brilliant pigment having a volume median size less than 5.37 μm is difficult to produce and low in yield. Further, a reason why the lower limit of the percentage of particles in the range of 2 to 4 μm in the volume distribution of the brilliant pigment for the developer D is set at 22.85% is to make the specular reflection area ratio not less than 20% and provide high surface smoothness.

As above, in the image forming apparatus 1, the percentage of particles in the range of 2 to 4 μm in the volume distribution of the brilliant pigment of the brilliant developer is appropriately set. Thereby, the image forming apparatus 1 can provide a printed image having a printed surface that has an FI value not less than 15 and high brilliance and has a specular reflection area ratio not less than 20% and good surface smoothness. Thus, the image forming apparatus 1 can form a high-quality image that does not look granular and looks like a mirror surface.

The image forming apparatus 1 according to this embodiment includes the image forming unit 10S including the developer container 12 containing the developer D having brilliance. The developer D contains the metallic pigment, binder resin, and external additive. The developer D contains particles of the metallic pigment not less than 2 μm and not more than 4 μm in the volume particle size distribution, and the percentage of the particles in a residue separated from a mixture obtained by dissolving the developer in tetrahydrofuran after removing the external additive from the developer is not less than 21.5% and not more than 25.3%.

The method of producing the brilliant developer D according to this embodiment is a method of producing a developer by using a dissolution suspension method, and includes dispersing at least a metallic pigment and a binder resin in an organic solvent to prepare a resin solution. The metallic pigment contains particles not less than 2 μm and not more than 4 μm in the volume particle size distribution, and the percentage of the particles in the metallic pigment is not less than 22.85% and not more than 26.62%.

Thus, by using the developer D, the image forming apparatus 1 can form a printed image having a printed surface that has high brilliance and has a high specular reflection area ratio and good surface smoothness.

With this embodiment, by using the above-described developer in the developing device of the image forming apparatus, it is possible to form a printed image having a printed surface that has high brilliance and has a high specular reflection area ratio and good surface smoothness, and form or print a high-quality image on a medium.

<7. Modifications>

In the above embodiment, the condition of the percentage of particles in the range of 2 to 4 μm in the volume distribution of the brilliant pigment for the developer D and the condition of the percentage of particles in the range of 2 to 4 μm in the volume distribution of the brilliant pigment in the developer D1 after external additive removal are defined on the basis of the measurement results and evaluation results. However, this is not mandatory. It is possible to define the condition of the percentage of particles in the range of 2 to 4 μm in the volume distribution of the brilliant pigment for the developer D and the condition of the percentage of particles in the range of 2 to 4 μm in the volume distribution of the brilliant pigment in the developer D1 after external additive removal, on the basis of the approximation equations shown in FIGS. 6A, 6B, 11A, and 11B.

Also, in the above embodiment, the brilliant pigment used in producing the developer D contains fine aluminum (Al) flakes having flat portions. However, this is not mandatory, and aluminum particles having other shapes, such as spherical shapes or rod shapes, may be used.

Also, in the above embodiment, the brilliant pigment used in producing the developer D contains aluminum (Al). However, this is not mandatory, and other metals, such as brass or iron oxide, may be used. In this case, the color exhibited by the developer fixed to a sheet P depends on the metal.

Further, in the above embodiment, developers used for one-component development have been described. However, this is not mandatory, and embodiments of the present invention are applicable to developers for other development methods, such as two-component development using carriers.

Further, in the above embodiment, the image forming apparatus 1 (see FIG. 1) is provided with five image forming units 10. However, this is not mandatory, and the image forming apparatus 1 may be provided with four or less or six or more image forming units 10.

Further, in the above embodiment, the present invention is applied to a single function printer. However, this is not mandatory, and embodiments of the present invention are applicable to image forming apparatuses having other functions, such as multi-function peripherals (MFPs) having a copier function and a facsimile function.

Further, in the above embodiment, the present invention is applied to an image forming apparatus. Embodiments of the present invention are applicable to various electronic devices, such as copiers, that form images on media, such as paper sheets, with developer by electrophotography.

Further, embodiments of the present invention are not limited to the above embodiment and modifications. Specifically, embodiments of the present invention may include embodiments obtained by arbitrarily combining some or all of the features of the above embodiment and modifications, and embodiments obtained by extracting some of the features of the above embodiment and modifications.

Further, in the above embodiment, the image forming apparatus 1 as an image forming apparatus is constituted by the image forming unit 10 as a developing device including the photosensitive drum 36 as a photoreceptor and the developing roller 34 as a developer carrier, and the fixing unit 70 as a fixing unit. However, this is not mandatory. An image forming apparatus may be constituted by a developing device including a photoreceptor and a developer carrier, and a fixing unit that have other configurations.

Embodiments of the present invention can be used in forming an image on a medium with a developer containing a metallic pigment by electrophotography.

What is claimed is:

1. A brilliant developer comprising:

a metallic pigment containing pigment particles;

a binder resin; and an external additive, wherein a percentage of the pigment particles not less than 2 μm and not more than 4 μm in a volume particle size distribution of a residue separated from a mixture obtained by dissolving the brilliant developer in tetrahydrofuran after removing the external additive from the brilliant developer is not less than 21.5% and not more than 25.3%.

2. The brilliant developer of claim 1, wherein the residue has a volume average particle size of not less than 5 μm and not more than 20 μm.

3. The brilliant developer of claim 1, wherein the pigment particles are flat-plate-shaped brilliant pigment particles, and the residue has a volume average particle size of not less than 5.44 μm and not more than 6.15 μm.

4. A developer container containing the brilliant developer of claim 1.

5. A developing device comprising:

a photoreceptor on which a latent image is formed by illumination; and a developer carrier that develops the latent image by supplying the brilliant developer of claim 1.

6. An image forming apparatus comprising:

the developing device of claim 5; and a fixing unit that fixes a developer image formed by the developing device to a medium.

7. A method of producing a developer by using a dissolution suspension method, the method comprising:

dispersing at least a metallic pigment and a binder resin in an organic solvent to prepare a resin solution, wherein the metallic pigment contains pigment particles, and wherein a percentage of the pigment particles not less than 2 μm and not more than 4 μm in a volume particle size distribution of the metallic pigment is not less than 22.85% and not more than 26.62%.

8. The method of claim 7, wherein the metallic pigment has a volume average particle size of not less than 5 μm and not more than 20 μm.

9. The method of claim 7, wherein the pigment particles are flat-plate-shaped brilliant pigment particles, and the brilliant pigment particles have a volume average particle size of not less than 5.37 μm and not more than 5.80 μm.

* * * * *